US005821481A

United States Patent [19]

Neubauer

[11] Patent Number: 5,821,481

[45] Date of Patent: Oct. 13, 1998

[54] QUICK-MAKE-QUICK-BREAK MICROSWITCH WITH WEDGE PROFILE AT THE CONTACT ARM PIVOT-MOUNTED IN THE SWITCH

[75] Inventor: Walter Neubauer, Lauffen, Germany

[73] Assignee: ITT Manufacturing Enterprises Inc., Wilmington, Del.

[21] Appl. No.: 817,466

[22] PCT Filed: Oct. 13, 1995

[86] PCT No.: PCT/EP95/04039

§ 371 Date: Jun. 20, 1997

§ 102(e) Date: Jun. 20, 1997

[87] PCT Pub. No.: WO96/12289

PCT Pub. Date: Apr. 25, 1996

[30] Foreign Application Priority Data

Oct. 15, 1994 [DE] Germany ..... 44 36 979.4

[51] Int. Cl.[6] ..... H01H 13/28

[52] U.S. Cl. ..... 200/4; 200/438; 200/449

[58] Field of Search ..... 200/4, 16 R–16 D, 200/402, 405, 410, 416, 417, 431, 434, 435, 437–439, 449, 468, 520, 533, 341

[56] References Cited

U.S. PATENT DOCUMENTS

| | | | |
|---|---|---|---|
| 3,187,133 | 6/1965 | Pierce | 200/77 |
| 3,869,590 | 3/1975 | Hults | 200/157 |
| 4,006,333 | 2/1977 | Hults | 200/157 |
| 4,636,597 | 1/1987 | Menche | 200/68.1 |
| 4,751,352 | 6/1988 | Botz et al. | 200/6 BB |
| 4,788,388 | 11/1988 | Burch et al. | 200/77 |
| 4,871,885 | 10/1989 | Kamada | 200/5 R |

FOREIGN PATENT DOCUMENTS

| | | | |
|---|---|---|---|
| 1117705 | 11/1961 | Germany . | |
| 2928214 | 1/1980 | Germany | H01H 13/28 |
| 3336877 | 5/1985 | Germany | H01H 13/56 |
| 3336878 | 5/1985 | Germany | H01H 13/52 |
| 3626241 | 2/1988 | Germany | H01H 5/04 |
| 3940285 | 6/1991 | Germany | H01H 3/46 |
| 3942925 | 6/1991 | Germany | H01H 25/04 |
| WO9612289 | 4/1996 | WIPO | H01H 5/04 |

OTHER PUBLICATIONS

English Translation of the International Preliminary Examination Report for International Application No. PCT/EP95/04039.

*Primary Examiner*—Michael A. Friedhofer

*Attorney, Agent, or Firm*—J. Gordon Lewis; Thomas N. Twomey

[57] ABSTRACT

A snap switch having spring a spring energy store and wedge profile. In conventional switches, the wedge profile was attached to the end of the contact arm, which forms the moving switching element. Heating of the contact arm due to large, switched electrical currents results in heating of the wedge profile and thus to a possible retardation of the switching, which, in turn, contributes to an additional heating of the wedge profile. The wedge profile is positioned where a low heat effect is expected. Thus, the wedge profile is seated under pretension at the switching element, where the contact arm forms a single sheet metal part whose one end senses the wedge profile.

6 Claims, 2 Drawing Sheets

QUICK-MAKE-QUICK-BREAK MICROSWITCH WITH WEDGE PROFILE AT THE CONTACT ARM PIVOT-MOUNTED IN THE SWITCH

BACKGROUND OF THE INVENTION

The invention pertains to a snap switch which is triggered by the movement of a switching element. In this case, a relative movement is carried out between a switching element and a wedge profile, wherein a spring energy store is charged until the switching element has passed the highest point of the wedge profile, and the spring energy store is then released and the contact arm suddenly changes over into its second switch position.

The principle of this type of switch is known, for example, from DE-PS 3,940,285. In this case, a switch cylinder prestressed by means of a pretensioning spring is used as the switching element; said switch cylinder moves during the switch actuation along a wedge profile which is brought to the end of the contact arm. This switch is composed of individual parts which are installed in a switch system on a common base plate. In addition, a corresponding switch is described in DE-OS 3,942,925.3.

For example, from DE-PS 2,928,214, it is known how to design a snap switch as a premanufactured microswitch, which can be located by means of the corresponding mounting devices at a suitable location within a larger switching system. In addition, it was proposed to design the snap switch known from DE-OS 3,940,285 as a microswitch, which can be installed as a switching block in a switching system.

Furthermore, from DE-PS 3,336,877 it is known how to design a snap switch by means of two mutually opposing wedge profiles.

Another switch of this kind is proposed in conjunction with DE-OS 4,418,707. Likewise, for this switch, as also in DE-PS 3,336,877, the end of the pivoting contact arm is provided with a wedge profile. A switch cylinder under spring force acts on this wedge profile, wherein said switch cylinder runs during actuation of the switching element across the crimped profile surface. Thus the axis of rotation of the switch cylinder is run in grooves in the direction of the prestressed tensioning spring, these grooves are located on lateral jaws of the switching element. In this design it has turned out to be disadvantageous if the wedge profile is located precisely at that structural element which is heated most by the passage of current and the switching processes. Consequently, a wedge profile made of plastic tends to change its dimensions. Thus it may happen that the side surfaces of the wedge profile abrade against the guide jaws of the switch cylinder and clamp fast due to the resulting, increased friction. This clamping leads to a retarded switching behavior, which, in turn, increases the generation of heat at the contact arm. Due to the mutually adverse effects, the desired number of switchings cannot always be attained.

SUMMARY OF THE INVENTION

Therefore the purpose of the invention is to improve the switching behavior for a switch of the described type. The problem is solved in the way that the switching element is provided with the control profile spring mounted to the switching element by means of a pretension, and that the contact arm has at its end facing the control profile, a sensing surface as switching element, which is connected as a single piece to the contact arm, wherein the sensing surface acts on the control profile and the sensing surface is convex to the control profile. In principle, the invention consists in general of eliminating the use of a switch cylinder and placing the wedge profile under pretension against the switching element. It is advantageous if the contact arm is a very simple, easily manufactured piece of sheet metal.

In addition, another disadvantage of the formerly proposed switch is eliminated which consisted in that the switch cylinder regularly acts on the contact arm via the wedge profile outside of the longitudinal axis of the contact arm. Thus, considerable torque is produced on the proposed switch with regard to the contact arm, which, during the attachment of the switching element, changes the force which is applied to the fixed contact of the contact mounted to the contact arm. By means of the invention, this disadvantage is corrected since the force of the wedge profile only acts on the longitudinal axis of the contact arm.

An additional advantage consists in that the wedge profile within the switching element can be seated very dependably without tilting, due to the short dimensions of the overall wedge profile. Owing to the relatively long contact arm at whose end the wedge profile was attached in the switch proposed above, a tilt-free mounting is very difficult to achieve, which was an additional hindrance to the operation of the proposed switch.

A particularly simple mounting of the wedge profile within the switching element is attained if the wedge-shaped control profile has a guide shoulder pointing away from the switching element for controlling the wedge profile in the switching element as well as holding a pretensioning spring. One particularly simple configuration in this regard is represented by a guide shoulder designed as a pot-shaped hollow body holding the pretensioning spring in its interior while its outer surface is used as a guide surface within a corresponding guide recess in the switching element. In this case, the hollow body can be designed both as a cylinder, which yields a particularly simple shape, as well as a rectangular cross section, which contributes toward a secure bearing of the wedge profile against twisting about its longitudinal axis.

In order to prevent the contact arm from migrating outward and to achieve a lateral control of the wedge profile, in one refinement of the invention the switching element is equipped with guide jaws which are in contact with the side surfaces of the wedge profile. Since the arrangement of the wedge profile at the switching element does not tend to heat up the wedge profile, a comparatively close tolerance of the control is possible, so that a precision switching behavior of the switch of the invention is promoted. But at the same time, in order to keep the switching element at the end of the contact arm from acting on the leading ends of the guide jaws of the switching element, the contact arm can engage the space between the guide jaws with its switching element during the actuation. is recommended in an additional refinement of the invention. Thus, a precise control of the switching element across the top surface of the wedge profile will also be assured when the contact arm exhibits significant heating due to high switching power.

One embodiment example of the invention will be explained in greater detail below with reference to the figures. Reference is made to the description of the snap switch stated above, so that only those features are explained which are essential to the present invention. In connection with the remaining features evident from the figures, the reader is referred to the descriptions of patent applications referenced above.

BRIEF DESCRIPTION OF THE DRAWINGS

Shown are.

DETAILED DESCRIPTION OF THE DRAWINGS

Figure 1:
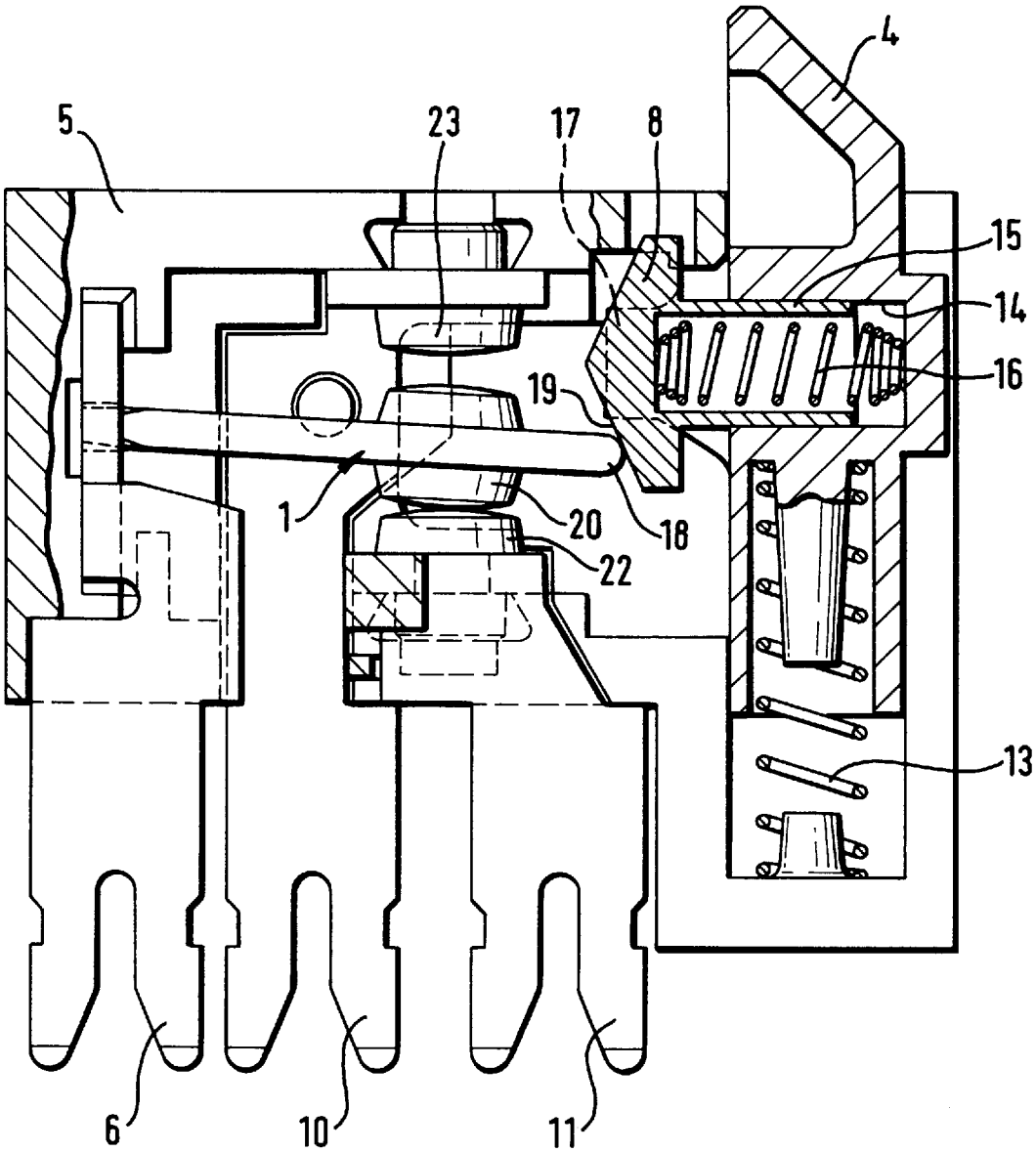
FIG. 1: A schematic cross section through a microswitch according to the present invention

The figures show a switch housing 5 which can be composed of several individual parts, held together by snap connections. A connecting piece 6 extends into the interior of the housing 5 of the microswitch; the end of a contact arm 1 is pivot mounted in an already known manner to said connecting piece.

Two mutually opposing contacts 22, 23 are provided for the contact 20 at the contact arm 1; these contacts belong to the connecting pieces 10, 11. In the two switch positions of the contact arm 1, the contact 20 of this lever is first connected to the fixed-switch contact 23 of the connecting piece 10, and then it is connected to the fixed-switch contact 22 of the connecting piece 11. The connecting pieces 6, 10 and 11 are inserted into two levels of the switch housing 5, as was described in conjunction with the aforesaid applications. As attachment for the connections in the housing, protrusions or recesses are used which cooperate in the switch housing 5 with corresponding elements of the connecting pieces and hold said pieces securely. By joining the parts of the housing, the connecting pieces are locked in their final position in the housing.

The switching element 4 in its longitudinal direction can slide longitudinally against the force of a restoring spring 13 in the housing 5. The restoring spring 13 can be omitted if no release state is provided for the switch, otherwise it is designed as a reversing switch. In this case, the actuation force on the switching element 4 must be able to act in two directions in order to bring the switching element 4 into both switch positions.

A guide recess 14 is provided in the switching element 4; a wedge profile 8 can slide longitudinally in it by means of a guide shoulder 15 and can move up against the abutment of a pretensioning spring 16. Suitable features are used to prevent the wedge profile from rotating about its longitudinal axis. This can be ensured by designing the guide recess and guide shoulder with an angular cross section, which prevents any twisting of the guide shoulder in the guide recess.

But also, lateral jaws 17 (indicated by dashed lines in FIG. 1) on the switching element 4 can also be used to ensure that the side surfaces of the wedge profile are guided parallel to the plane of FIG. 1 and so that it cannot tilt with respect to them.

The contact arm 1 is provided on its end facing the wedge profile 8 with a switching element 18, which has essentially the shape of a semicircular cylinder in the present embodiment; said cylinder forms the end of the contact arm 1 and is connected to it as a single piece.

Thus, the switching element 18 rests along a line against the contour 19 of the wedge profile 8, wherein the pretensioning spring 16 will ensure a sufficient contact pressure of the contact attached to the contact arm 1, with respect to the associated contact 22 or 23 of the connecting piece 11 or 10. This contact pressure is applied by means of the wedge profile 8, the switching element 18 and the contact arm 1.

Figure 2:
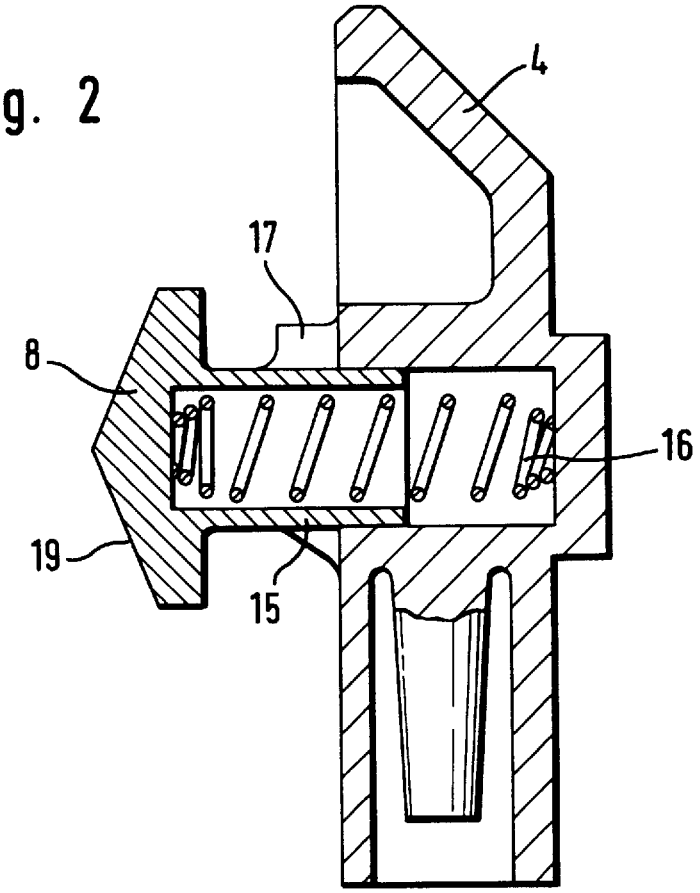
FIG. 2: A side view of the switching element 4 with wedge profile controlled therein.
Figure 3:
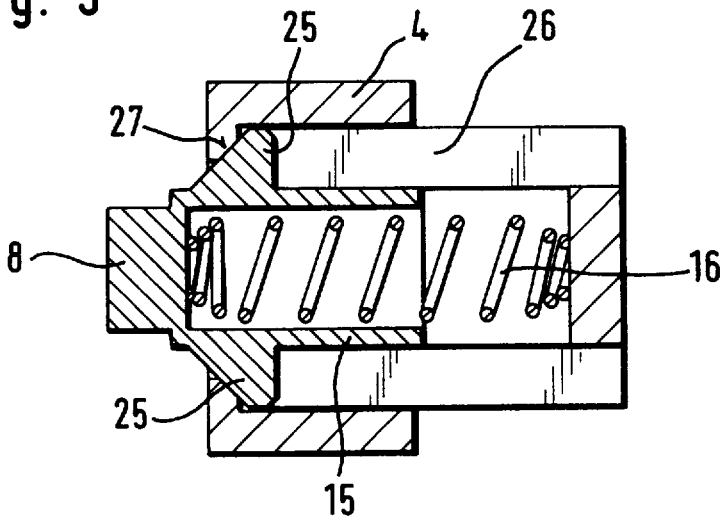
FIG. 3: A top view of the switching element according to FIG. 2, shown in cutaway form.

The switching element 4 is indicated in FIGS. 2 and 3; the wedge profile 8 is seated in such a manner as to slide longitudinally in said switching element.

The wedge profile 8 is provided with two additional guide flanks 25 next to the shoulder 15; these flanks fit into corresponding grooves of the switching element 4 and ensure a torsion-free longitudinal control of the wedge profile 8. Accordingly, the guide shoulder 15 can have the form of a cylinder. The guide flanks 25 are inclined obliquely in the direction of the wedge profile 8. The inclination of these guide flanks corresponds to a corresponding slope of contact surfaces at the walls 27 adjoining the guide grooves 26 in this direction.

For the present invention it is not absolutely necessary that the contour 19 be in the form of a wedge. Likewise, it is not necessary that the switching element 18 be of a semicircular cylindrical design. It is only essential to the invention that the contour ensuring the prestressing of the contact arm 1 be located at an element that can move within the switching element 4, and that the contact arm, which heats up under high switching power, be free of any plastic coating, as was proposed in the applications discussed above.

I claim:

1. An electrical switch, comprising:

a housing, having a contact arm movable between two terminal positions, wherein said arm is pivotally mounted in the housing and includes a convex sensing surface and a moving switch element, at least one fixed contact which is rigidly mounted in the housing and is capable of being contacted by said moving switch element, wherein the switch element, by means of relative motion between said sensing surface and a control profile, causes a switch of the contact arm under tension of a pretensioning spring, wherein the switch element is provided with a control profile spring mounted to the switch element by means of a pretension, wherein said convex sensing surface is connected as a single piece to the contact arm, and acts on the control profile wherein the control profile is equipped with side surface guide jaws and secure said switching element against a rotational movement about the longitudinal axis of the switching element.

2. The electrical switch according to claim 1, wherein the control profile designed as a wedge profile has a guide shoulder pointing away from the switching element, which ensures both a control of the wedge profile in the switching element, as well as the holding of a pretensioning spring.

3. The electrical switch according to claim 2, wherein the guide shoulder is a pot-shaped hollow body which holds an interior the pretensioning spring and whose outer surface is used as a guide surface within a corresponding guide recess in the switching element.

4. An electrical switch, comprising:

a housing, having a contact arm moving between two terminal positions, wherein said arm is pivotally mounted in the housing and includes a convex sensing surface and a moving switch element, at least one fixed contact which is rigidly mounted in the housing and is capable of being contacted by said moving switch element, wherein the switch element, by means of relative motion between said sensing surface and a control profile, causes a switch of the contact arm under tension of a pretensioning spring, wherein the switch element is provided with a control profile spring mounted to the switch element by means of a pretension, wherein said convex sensing surface is connected as a single piece to the contact arm, and acts on the control profile, wherein the convex surface of said control profile is formed by spaced apart side surface guide jaws.

5. An electrical switch, comprising:

a housing, having a contact arm moving between two terminal positions, wherein said arm is pivotally mounted in the housing and includes a convex sensing surface and a moving switch element, at least one fixed contact which is rigidly mounted in the housing and is capable of being contacted by said moving switch element, wherein the switch element, by means of relative motion between said sensing surface and a control profile, causes a switch of the contact arm under tension of a pretensioning spring, wherein the switch element is provided with a control profile spring mounted to the switch element by means of a pretension, wherein said convex sensing surface is connected as a single piece to the contact arm, and acts on the control profile, wherein the convex surface of said control profile includes a guide shoulder having guide flanks.

6. The electrical switch according to claim 5, wherein the guide flanks include abutment surfaces.

* * * * *